United States Patent [19]

Scheck

[11] Patent Number: 4,478,426

[45] Date of Patent: Oct. 23, 1984

[54] SKI SAFETY BINDING

[75] Inventor: Georg Scheck, Leonberg, Fed. Rep. of Germany

[73] Assignee: Geze GmbH, Fed. Rep. of Germany

[21] Appl. No.: 395,625

[22] Filed: Jul. 6, 1982

[30] Foreign Application Priority Data

Jul. 27, 1981 [DE] Fed. Rep. of Germany ..... 3129536

[51] Int. Cl.[3] ..... A63C 9/08

[52] U.S. Cl. ..... 280/625; 280/629

[58] Field of Search ..... 280/625, 629, 630, 628

[56] References Cited

U.S. PATENT DOCUMENTS

| | | | |
|---|---|---|---|
| 3,840,240 | 10/1974 | Covini | 280/629 |
| 3,902,730 | 9/1975 | Tschida et al. | 280/625 |
| 4,087,114 | 5/1978 | Csosz | 280/625 |
| 4,303,260 | 12/1981 | Poellmann | 280/625 |
| 4,336,956 | 6/1982 | Richert et al. | 280/629 |

FOREIGN PATENT DOCUMENTS

| | | | |
|---|---|---|---|
| 2612069 | 9/1977 | Fed. Rep. of Germany | 280/625 |

*Primary Examiner*—David M. Mitchell

[57] ABSTRACT

A ski safety binding has a sole clamp 14, preferably formed as two sole clamp halves 14', 14'', which is pressed by spring force against first and second abutment surfaces 12 provided on the binding housing 24 on respective sides of the central longitudinal axis 11. The first and second abutment surfaces 12 extend, at least in part, obliquely outwardly in the direction towards the ski boot in such a way that, during sideways release, the sole clamp 14 pivots about one or other of its points of contact 13 with the first and second abutment surfaces 12 and the associated point of contact 13 moves in the longitudinal direction of the ski in substantially exactly the same way as the vertical pivot axle 15 connecting the sole clamp to the release spring and draw rod assembly 31, 29 (FIG. 2). This means that the draw rod moves in a straight line without angular movement as in the prior art.

8 Claims, 3 Drawing Figures

SKI SAFETY BINDING

Figure 1:
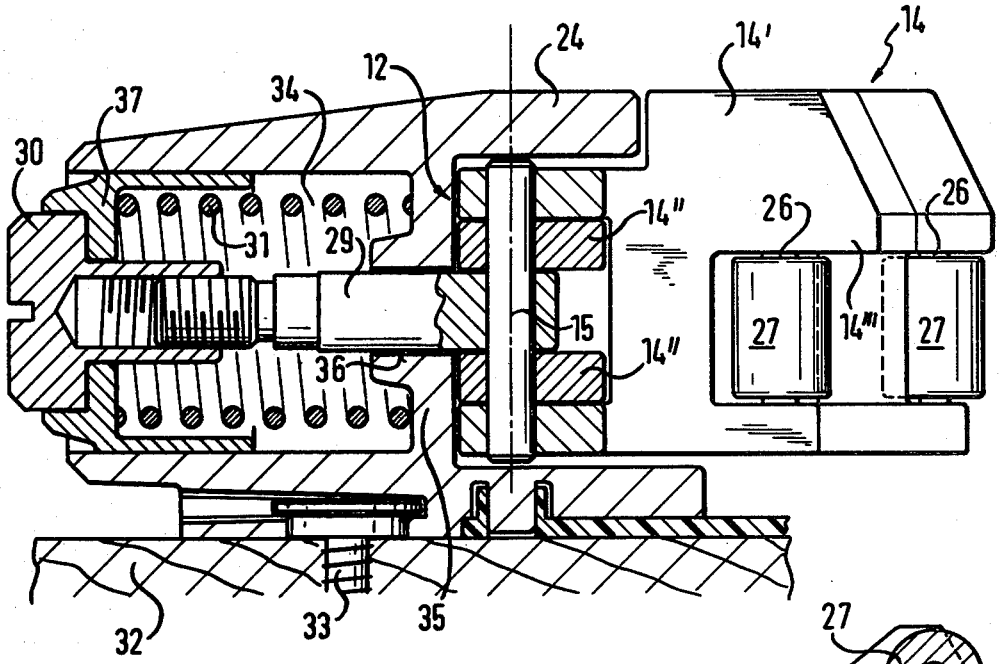

The invention relates to a ski safety binding for mounting on a ski and more particularly to a ski safety binding of the type having sole clamp means which can pivot sideways against spring bias to release a ski boot once the release setting of the binding has been exceeded thus preventing injury to the skier.

A known ski safety binding (DE-PS 25 58 339) comprises a housing having a central longitudinal axis, sole clamp means provided at said housing for locating a ski boot longitudinally and transversely relative to the ski, first and second abutment surfaces provided on the housing on either side of the central longitudinal axis, cooperating abutment surfaces provided on said sole clamp means and spring means acting on the sole clamp means at a vertical pivot axle to bias the sole clamp means towards the housing. The arrangement is such that the bias force exerted by the spring means results in respective points of contact between the first and second abutment surfaces and the cooperating abutment surfaces while allowing sideways pivotal movement of the sole clamp means relative to the housing with associated outward movement of a respective one of said points of contact.

In this known arrangement the sole clamp means takes the form of a single sole clamp member and the associated outward movement of the points of contact during sideways release is intended to effectively reduce the release setting at the start of lateral release so that the influences of the forwardly directed thrust from the heel binding, and of ice and snow in the binding, on the release behaviour are reduced. As the sideways release movement increases the disadvantageous influences which have been mentioned reduce however so that, by displacing the point of abutment outwardly, the release setting in the sideways direction can be effectively increased and indeed to the normal value related to the danger of breakage of the skier's leg.

The spring means which generates the spring force required to press the sole clamp against the abutment surfaces generally consists of a draw bar which extends in the longitudinal direction of the ski through the housing and which is attached at its end adjacent the sole clamp to the sole clamp at the vertical pivot axle. A release spring in the form of a compression coil spring which is braced against the binding housing at its end facing the sole clamp bears on the other end of the draw rod, preferably via a bias adjustment nut.

As the sole clamp executes a pivotal movement about its point of support on the housing the pivot axle at the draw rod moves along a circular track so that corresponding lateral tolerances must be provided in the guide for the draw rod and in the guide for the spring arrangement.

One object of the present invention is to provide a ski safety binding of the kind initially described in which the pivot axle moves almost exactly in the longitudinal direction of the ski during sideways pivotal movement of the sole clamp means, so that an accurately fitting longitudinal guide can be provided for the spring arrangement and for the draw rod.

In order to satisfy this object there is provided, in accordance with the invention, a ski safety binding comprising a housing having a central longitudinal axis; sole clamp means provided at said housing for locating a ski boot longitudinally and transversely relative to the ski; first and second abutment surfaces provided on said housing on either side of said central longitudinal axis and cooperating abutment surfaces provided on said sole clamp means; and spring means acting on said sole clamp means at a vertical pivot axle to bias said sole clamp means towards said housing to produce respective points of contact between said first and second abutment surfaces and said cooperating abutment surfaces, while allowing sideways pivotal movement of said sole clamp means relative to said housing with associated outward movement of a respective one of said points of contact; and wherein said first and second abutment surfaces are directed obliquely outwardly in a direction towards the ski boot over at least a substantial part of their extent so that, on sideways pivotal movement of said sole clamp means the point of contact moves in the longitudinal direction of the ski in substantially exactly the same way as the vertical pivot axle.

In this way the pivot axle for the spring means, and in particular the end of the draw rod, does not execute a circular movement but instead a linear movement in the direction of the longitudinal axis of the ski. In this way the spring means and the draw rod can be guided in a considerably more precise manner than is possible with the known ski safety binding.

During sideways pivotal movement of the sole clamp the point of contact between the sole clamp and the support surface always remains at practically the same position along the ski as the pivot axle connecting the sole clamp to the spring means, i.e. at the same position relative to the end of the draw rod. As the point of contact simultaneously moves outwardly during the sideways pivotal movement of the sole clamp the influence of the thrust from the heel binding on the force required to produce release becomes increasingly smaller.

A further advantage of the invention lies in the fact that a larger lever arm between the central longitudinal axis and the point of contact is present at larger lateral deflections, when the lateral shoe support point is located nearer to the front edge of the sole of the ski boot, and this longer lever arm compensates for the resulting force reduction which occurs with such larger lateral deflections.

The important advantage of the invention lies however in the fact that the spring means, and in particular the draw rod is guided in a substantially straight line during a sideways safety release.

It should be noted that the sole clamp of the invention not only supports the ski boot in the longitudinal direction of the ski and transversely of the ski but also in the upward direction. The ski safety binding of the invention could admittedly be used, in principle, also as a heel binding, it is however intended primarily as a toe binding which cooperates with a heel binding which exerts a forwardly directed thrust on the ski boot and thus on the toe binding.

In a further advantageous embodiment of the invention each of the first and second abutment surfaces has a transverse zone at its inner end and each transverse zone is aligned with the vertical pivot axle in the rest position of the binding, has a finite extent in the transverse direction and contacts a corresponding countersurface of the sole clamp means.

Thus flat regions are provided relatively close to the central longitudinal axis on both the housing and the sole clamp means so that, in the rest position, these two parts contact one another over a large area with the result that little wear occurs after release and rapid return of the sole clamp to its rest position.

In order to reach the actual safety roll-off region of the binding as quickly as possible during sideways release each of the first and second abutment surfaces should preferably have, in sequence, in the transverse direction going away from the central longitudinal axis, a zone which is steeply inclined to the transverse direction and an adjoining zone which is less steeply inclined to the transverse direction.

The counter-surfaces of the sole clamp means facing each of said steeply inclined zones are preferably even more steeply inclined so that on sideways pivotal movement of the sole clamp means no contact occurs at the steeply inclined zones.

In a further embodiment of the invention the counter-surfaces of the sole clamp means facing said less steeply inclined zones are constructed, as seen in plan view, as a lightly convexly rounded roll-off surface.

In this manner the points of contact of the sole clamp means on the first and second abutment surfaces move from the transverse zones at the inner ends of the first and second abutment surfaces to the actual safety roll-off zones after only a small sideways pivotal movement of the sole clamp means.

In a further embodiment of the invention, which is intended to prevent contamination or dirt entering into the sensitive zone between the first and second abutment surfaces and the cooperating counter-surfaces via the gaps that are present between these surfaces, the transversely outer ends of the gaps are sealed by a sealing lip on one of the housing or sole clamp means which surrounds a seal surface provided on the other one of said housing or sole clamp means.

The invention is used with special advantage in a ski safety binding in which the sole clamp means consists of first and second sole clamp halves which are independently pivotally attached to the same pivot axle. In this arrangement each of the sole clamp halves has ski boot support regions near the central longitudinal axis of the binding and at its transversely outer end. These ski boot support regions preferably take the form of rollers rotatable about vertically disposed axes.

As previously mentioned the ski safety binding of the invention is particularly intended for use as a toe unit in cooperation with a heel binding which exerts a forwardly directed force on the toe unit via the sole of the ski boot. This arrangement is particularly preferred when the sole clamp consists of first and second sole clamp halves. In this case the outer ski boot support regions should be spaced from the central longitudinal axis by a distance such that the forwardly directed force from the heel binding pivots each sole clamp half outwardly until the sole of the ski boot contacts both of the ski boot support regions of each of the sole clamp halves.

Various two piece sole clamps are indeed known already (for example from German Offenlegungsschrift 26 16 344, German Pat. No. 23 12 268, German Offenlegungsschrift 15 78 975 and U.S. Pat. No. 35 84 891). These known two piece sole clamps are however attached to the toe unit about fixed pivot axles and are not arranged to roll on abutment surfaces during sideways release as occurs with the sole clamp halves described herein.

When compared with all the known arrangements ski safety bindings with two part sole clamps in accordance with the invention have the important advantage that the binding automatically adjusts to the width of the sole of the ski boot provided an appropriate forwardly directed force is available from the heel unit. The forwardly directed thrust from the heel unit pivots the two sole clamp halves outwardly in opposite directions until the two ski boot support regions, which are preferably rollers, of each sole clamp half firmly contact the sole of the ski boot. During this movement the points of contact of the sole clamp halves on the first and second abutment surfaces of the housing move outwardly to a greater or lesser degree depending on this size of the ski boot. During this movement the pivot axis at which the spring means or draw rod acts on the sole clamp halves executes a practically straight line movement. As only a relatively small angular displacement of the sole clamp halves is necessary to accommodate very different sizes of ski boot soles the release behaviour of the binding remains unchanged by the automatic matching to the sole of the ski boot which is possible, in accordance with the invention, if the point of support of the sole clamp halves lies considerably further inwardly for the smallest inserted ski boot sole than the position which corresponds to the lateral force required to produce safety release. In other words an inwardly disposed roll-off zone for the sole clamp halves on the first and second abutment surfaces of the housing is available to accommodate ski boots of different sizes whereas the laterally adjoining regions are used for safety release.

Figure 2:
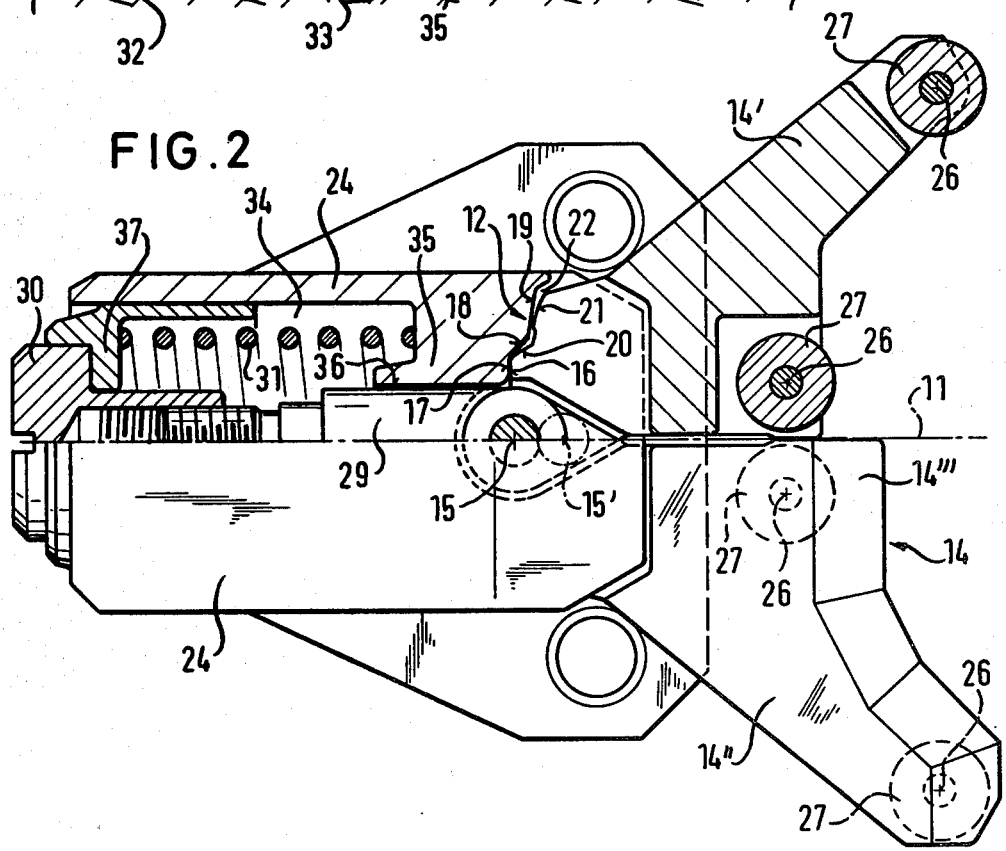
Figure 3:
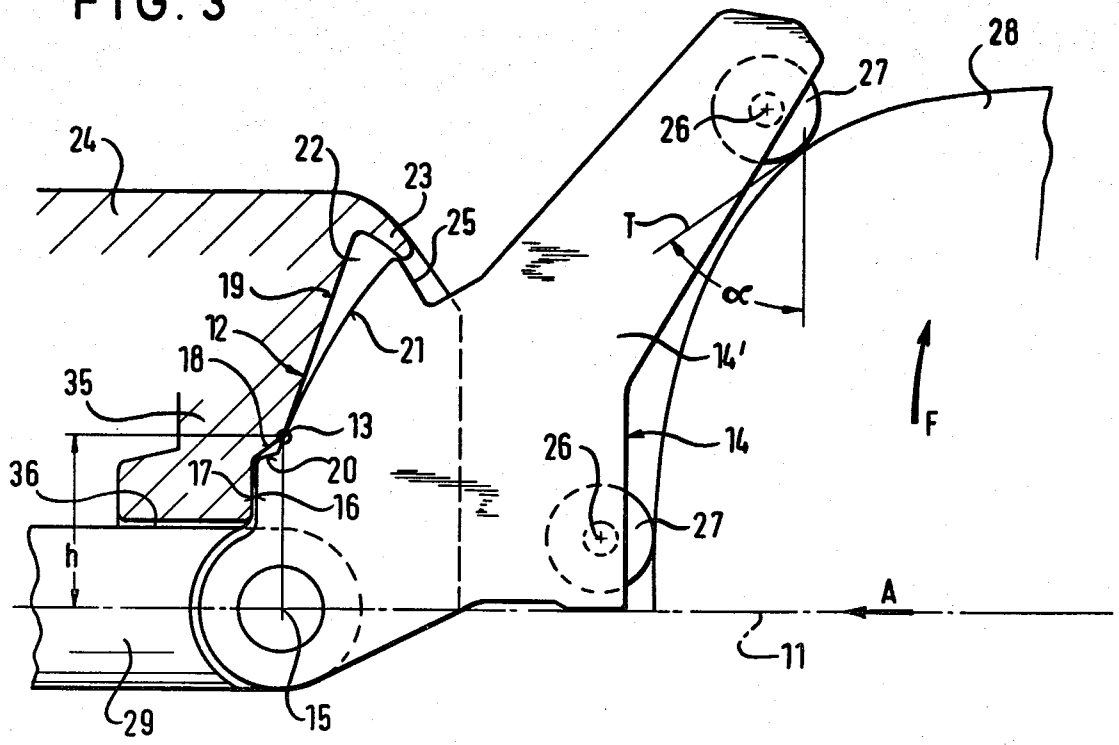

The invention will now be described in further detail in the following with reference to the drawings which show:

FIG. 1 a partly sectioned side view of a ski safety binding in accordance with the invention taken along its central longitudinal axis, FIG. 2 a partly sectioned plan view of the subject of FIG. 1, and FIG. 3 a plan view similar to FIG. 2 but taken only on one side of the central longitudinal axis showing a ski boot in position in the binding.

As seen in the drawings the binding basically comprises a binding housing 24 having a central longitudinal axis 11 and sole clamp means 14 in the form of first of second sole clamp halves 14', 14" which are provided at the housing 24 for locating a ski boot 28 longitudinally and transversely relative to the ski 32.

A forwardly disposed hollow chamber 34 is provided in the binding housing 24 and a release spring 31 in the form of a compression coil spring is inserted into the hollow chamber 34 via its open front end. The release spring 31 is braced against an intermediate wall 35 provided at the rear end of the chamber 34. The intermediate wall 35 has a central opening 36. A substantially cylindrical spring abutment 37 is inserted into the front end of the chamber 34 and the front end of the release spring 31 is braced against this spring abutment. The spring abutment 37 bears on an adjustment nut 30 which is provided at the front end of the housing 24 and is screwed onto the forward threaded portion of a draw rod 29. The draw rod 29 passes at its rear end through the opening 36 without significant tolerances and is then pivotally connected behind the intermediate wall 35 to the two sole clamp halves 14', 14" at a vertical pivot axle 15. Each of the sole clamp halves is of symmetical construction relative to the central longitudinal axis 11 as seen in the plan view of FIG. 2. The sole clamp halves 14', 14" jointly form the sole clamp means 14 which not only secures the ski boot 28 (FIG. 3) longitudinally and transversely relative to the ski but also in the upward direction.

In the vicinity of the central longitudinal axis 11 the sole clamp halves 14', 14'' have rollers 27 which are rotatable about vertical axes 26 and which represent the front support regions for the ski boot 28.

Further rollers 27 which can likewise rotate about vertical axes 26 are provided at the transversely outer ends of the sole clamp halves 14', 14'' which project obliquely rearwardly and contact the sole of the ski boot 28 (FIG. 3) between the front and side edges at an angle of approximately 45°. A projection 14''' (FIG. 1) provided on each of the sole clamp halves 14', 14'' engages over the sole of the ski boot from above. In the rest position illustrated in FIGS. 1 and 2 the draw rod 29 draws the sole clamp halves 14', 14'' against first and second abutment surfaces 12 which are provided at the rear end of the housing 24 on either side of the central longitudinal axis 11 and which are specially shaped in accordance with the invention.

As seen in FIG. 2 counter-surfaces 16 provided at the front ends of the sole clamp halves 14', 14'' near to the central longitudinal axis 11 bear, in the rest position of the binding without a ski boot, on transverse zones 17 of the first and second support surfaces 12. These transverse zones 17 extend over a certain distance in the transverse direction and are substantially aligned in the transverse direction with the vertical pivot axle 15. The transverse zones 17 thus lie at the transversely inner ends of the first and second abutment surfaces 12.

In the transverse direction moving outwardly the transverse zones 17 are followed by zones 18 which are steeply inclined to the transverse direction at an angle of approximately 45° and adjoining zones 19 which are substantially less steeply inclined to the transverse direction. The zones 17, 18, 19 jointly form the abutment surfaces 12 on each side of the central longitudinal axis. Counter-surfaces 20 which are substantially more steeply inclined to the transverse direction are provided at the front ends of the sole clamp halves 14', 14'' facing the zones 18. These counter-surfaces 20 are followed by outwardly directed counter-surfaces 21 which face the less steeply inclined zones 19 of the first and second abutment surfaces 12 and a "roll-off" gap 22 is left between the zones 19 and the corresponding counter-surfaces 21.

As seen in FIG. 3 a sealing lip 23 is provided at the outside of the housing 24 and engages around corresponding oppositely disposed sealing surfaces 25 of the sole clamp halves 14', 14'' in such a way that the "roll-off" gap 22 is sealed against the external environment both in the rest position and in the outwardly pivoted positions of the sole clamp halves 14', 14''.

In the rest position of FIGS. 1 and 2 the counter-surfaces 16 contact the transverse zones 17 of the first and second abutment surfaces. The remaining zones of the abutment surfaces are spaced from the cooperating counter-surfaces by the distance shown in FIG. 2.

If now, in accordance with FIG. 3, a ski boot is inserted in the binding and is pressed forwardly against the rollers 27 of the sole clamp halves 14', 14'' by a forwardly directed force A from a heel binding a spreading force is exerted on the sole clamp halves 14', 14'' which results in both sole clamp halves 14', 14'' pivoting sideways until the ski boot makes full contact with all four rollers 27. During this outward movement of the sole clamp halves the draw rod 29 is drawn via the pivot axle 15 somewhat towards the ski boot 28 with a minimal compression of the release spring 31.

During this movement the counter-surfaces 16 and the transverse zones of the first and second abutment surfaces 12 move out of engagement and the points of contact 13 between the sole clamp halves and the first and second abutment surfaces move transversely outwardly to the start of the zones 19 and the counter-surfaces 21 which represent the actual release curve. Depending on the width of the sole of the inserted ski boot 28 the point of contact 13 moves outwardly to a greater or lesser degree into the operational position which can be seen from FIG. 3 so that the distance h indicated in FIG. 3 fluctuates depending on ski boot size. As a result of the special construction of the first and second abutment surfaces 12 and the counter-surfaces 16, 20, 21 the points of contact 13 always remain transversely aligned with the pivot axis 15 so that the draw rod 29 can be guided with relatively narrow tolerances in the bore 36 of the intermediate wall 35.

If a lateral force F (FIG. 3) which is sufficient to deflect the sole clamp means occurs at the ski boot the angle of engagement $\alpha$, illustrated in FIG. 3, between the direction of movement of the ski boot 28 and the tangent t at the outer roller 27 continuously reduces, i.e. the release force falls. As however the points of contact 13 between the sole clamp halves 14' and 14'' and the housing 24 wander transversely outwardly while remaining in lateral alignment with the pivot axle 15 the lever arm h increases which is equivalent to an increase of the release force. In this manner the release force which is reducing due to reduction of the engagement angle $\alpha$ is so compensated that, taking account of all influences, the release force exerted by the ski boot on the binding remains substantially constant within a specific range during sideways pivotal movement of the sole clamp half on which the ski boot is acting.

With a two part sole clamp the other sole clamp half need not partake in the movement of the ski boot and thus frictional effects due to this sole clamp half can be neglected.

I claim:

1. A ski safety binding for mounting on a ski, the ski safety binding comprising a housing having a central longitudinal axis; sole clamp means provided at said housing for locating a ski boot longitudinally and transversely relative to the ski; first and second abutment surfaces provided on said housing on respective sides of said central longitudinal axis, each of said first and second abutment surfaces having a respective region extending in a direction generally transverse to said central longitudinal axis and being obliquely inclined relative thereto; third and fourth abutment surfaces provided on said sole clamp means, said third and fourth abutment surfaces respectively facing and cooperating with said regions of said first and second abutment surfaces and having respective lightly convexly rounded regions which are also generally obliquely inclined relative to said central longitudinal axis; a vertical pivot axle extending through said sole clamp means; a transverse wall in said housing, said transverse wall having an aperture therein and first and second sides; a draw rod having first and second ends, said draw rod being connected by said first end to said vertical pivot axle on said first side of said transverse wall and extending through said aperture in said transverse wall; and spring means on said second side of said transverse wall, said spring means acting on said second end of said draw rod to bias said sole clamp means towards said housing to produce respective points of contact between said first and second abutment surfaces and said cooperating third and fourth abutment surfaces; wherein said abutment surfaces are arranged so that said sole clamp means may pivot, under a sideways force applied via said ski boot, to either side of said housing about a respective one of said points of contact, from a rest position adopted when said boot is present in said binding to a release position, with simultaneous outward movement of the respective one of said points of contact as the associated one of said lightly convexly rounded regions rolls on the associated one of said first and second surfaces; and wherein the associated one of said points of contact move in the direction of said central longitudinal axis in substantially exactly the same way as the vertical pivot axle moves in the direction of said central longitudinal axis.

2. A ski safety binding in accordance with claim 1 wherein each of said first and second abutment surfaces has a respective transverse zone adjacent said central longitudinal axis, wherein each transverse zone is substantially aligned with the vertical pivot axle in a rest position of the binding adopted prior to engagement of a ski boot in said binding, has a finite extent in the transverse direction and contacts a corresponding countersurface of the associated one of said third and fourth abutment surfaces.

3. A ski safety binding in accordance with claim 2 wherein, in a transverse direction, said first and second abutment surfaces have respective steep zones intermediate said transverse zones and said regions, with said steep zones being steeply inclined to said transverse direction.

4. A ski safety binding in accordance with claim 3 wherein said third and fourth abutment surfaces also have respective steep zones facing said steep zones of said first and second abutment surfaces, said steep zones of said third and fourth abutment surfaces being even more steeply inclined to said transverse direction so that on sideways pivotal movement of said sole clamp means no contact occurs at said steep zones.

5. A ski safety binding in accordance with claim 1 wherein respective gaps are present between said first and second abutment surfaces and said cooperating third and fourth abutment surfaces, and wherein transversely outer ends of said gaps are sealed by a respective sealing lips provided on one of said housing and said sole clamp means, said sealing lips surrounding respective seal surfaces provided on the other one of said housing and said sole clamp means.

6. A ski safety binding in accordance with claim 1 and wherein said sole clamp means consists of first and second sole clamp halves which are independently pivotally attached to said vertical pivot axle.

7. A ski safety binding in accordance with claim 6 and wherein each of said sole clamp halves has first and second ski boot support regions respectively disposed near said central longitudinal axis of the binding and at a transversely outer end of that sole clamp half.

8. A ski safety binding in accordance with claim 7 wherein said ski boot support regions comprise rollers rotatable about vertically disposed axes.

* * * * *